United States Patent [19]

Jasper, Jr. et al.

[11] Patent Number: 4,612,476

[45] Date of Patent: Sep. 16, 1986

[54] BROADBAND TRANSVERSE FIELD INTERACTION CONTINUOUS BEAM AMPLIFIER

[75] Inventors: Louis J. Jasper, Jr., Ocean; Charles M. De Santis; James F. Baxendale, both of Neptune, all of N.J.

[73] Assignee: The United States of America as Represented by the Secretary of the Army, Washington, D.C.

[21] Appl. No.: 638,183

[22] Filed: Aug. 6, 1984

[51] Int. Cl.[4] ..... H01J 25/34

[52] U.S. Cl. ..... 315/3.6; 315/5.14; 315/5.16; 315/5.37; 315/39.3

[58] Field of Search ..... 315/3.6, 3.5, 39.3, 315/5.14, 5.16, 5.36, 5.37

[56] References Cited

U.S. PATENT DOCUMENTS

| | | | |
|---|---|---|---|
| 2,683,256 | 7/1954 | Kumpfer | 315/3.5 |
| 2,698,398 | 12/1954 | Ginzton | 315/5.37 X |
| 2,721,957 | 10/1955 | Neher | 315/5.14 X |
| 2,768,328 | 10/1956 | Pierce | 315/3.5 |
| 2,774,005 | 12/1956 | Kazan | 315/39.3 X |
| 2,892,963 | 6/1959 | Dench | 315/3.6 |
| 2,898,507 | 8/1959 | Clarke | 315/3.6 |
| 3,107,313 | 10/1963 | Hechtel | 315/5.16 |
| 3,237,047 | 2/1966 | Webster | 315/5.37 X |
| 3,760,219 | 9/1973 | DeSantis et al. | 315/3.5 |
| 4,210,845 | 7/1980 | Lebacqz | 315/39 |

*Primary Examiner*—Saxfield Chatmon

*Attorney, Agent, or Firm*—Anthony T. Lane; Jeremiah G. Murray; Edward Goldberg

[57] ABSTRACT

A broadband transverse field interaction continuous beam amplifier device comprised of an elongated continuous cathode modulating grid structure, an elongated continuous demodulating grid-collector structure, first or input waveguide transmission line means including the modulating grid for propagating an input RF wave transversely to an electron beam traveling from the cathode-grid structure to the output-collector structure where the electrons are bunched or modulated by the process of transverse wave interaction, and second or output waveguide transmission line means including the demodulating grid for propagating an induced amplified RF output wave resulting from prebunched electrons traversing the demodulator grid. Both input and output transmission line means include slow wave structures which are implemented in the grid structures.

4 Claims, 13 Drawing Figures

FIG. 1
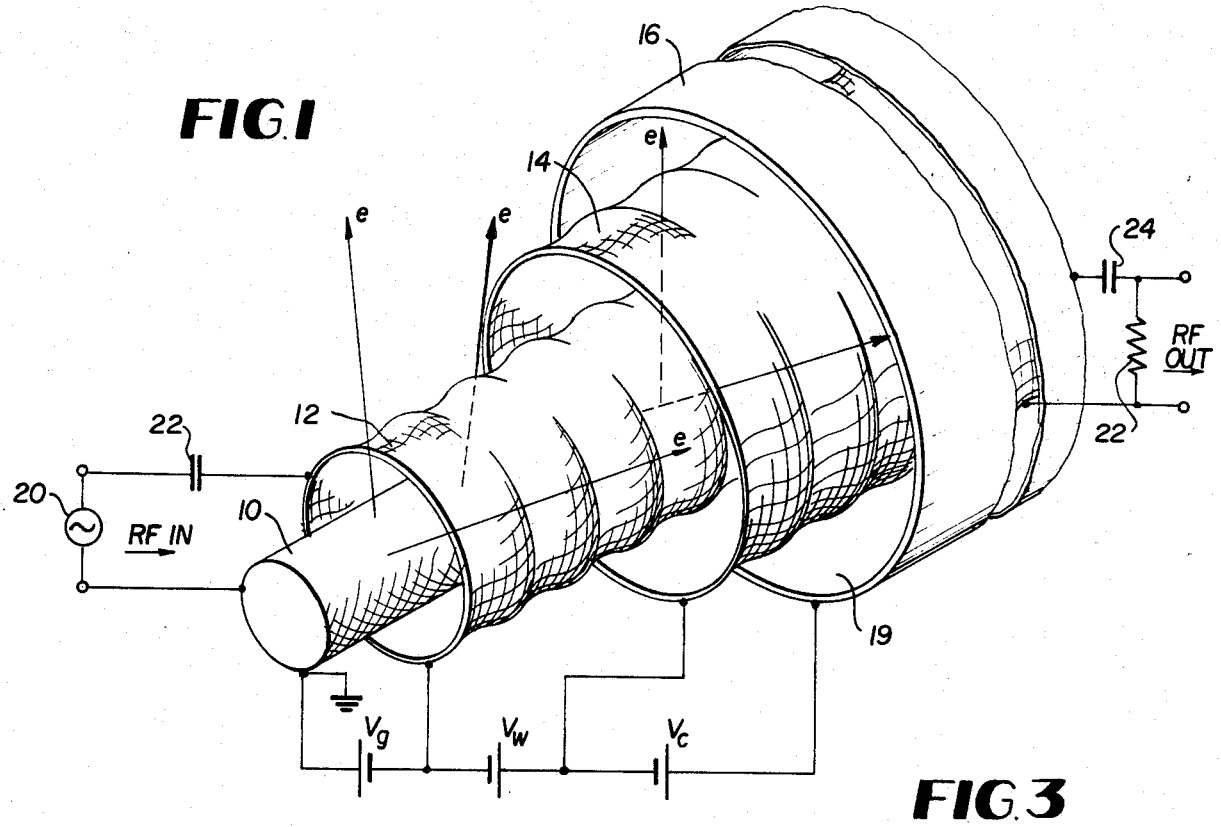
FIG. 3
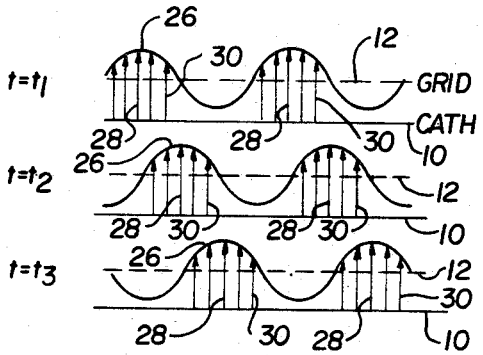
FIG. 2
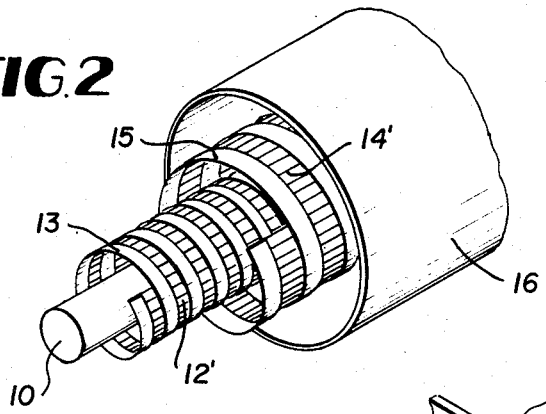
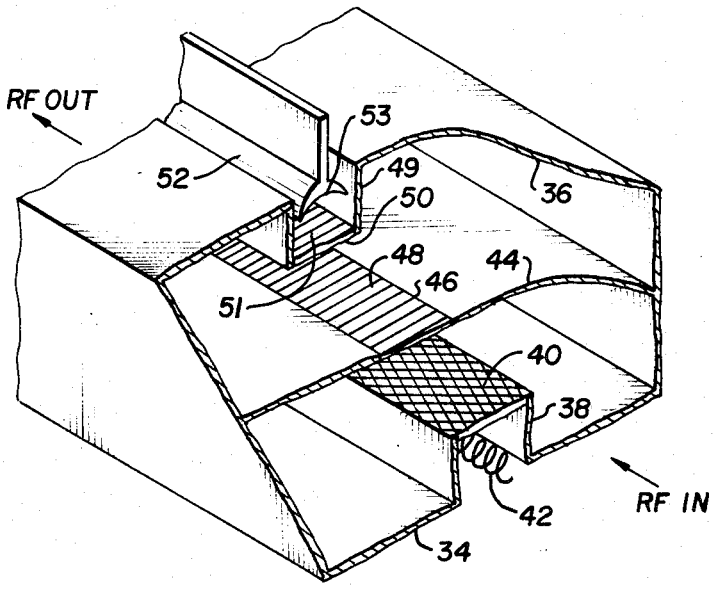
FIG. 4

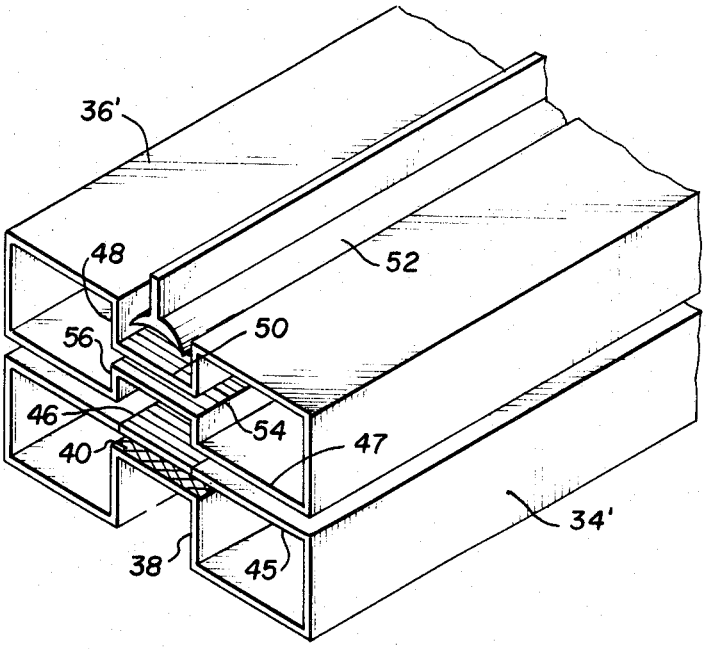
FIG. 5
FIG. 6A
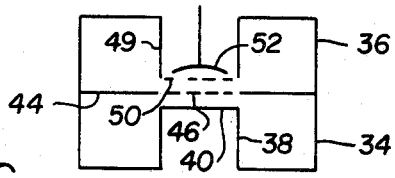
FIG. 6B
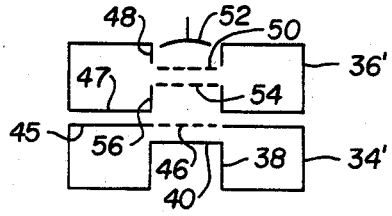
FIG. 6C
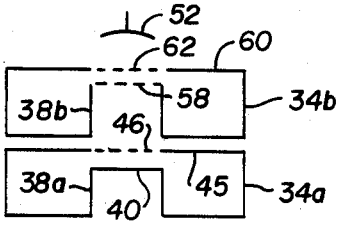
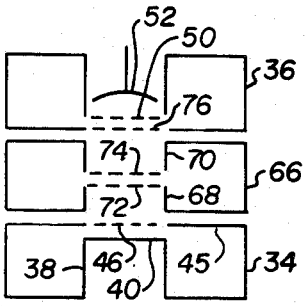
FIG. 6D
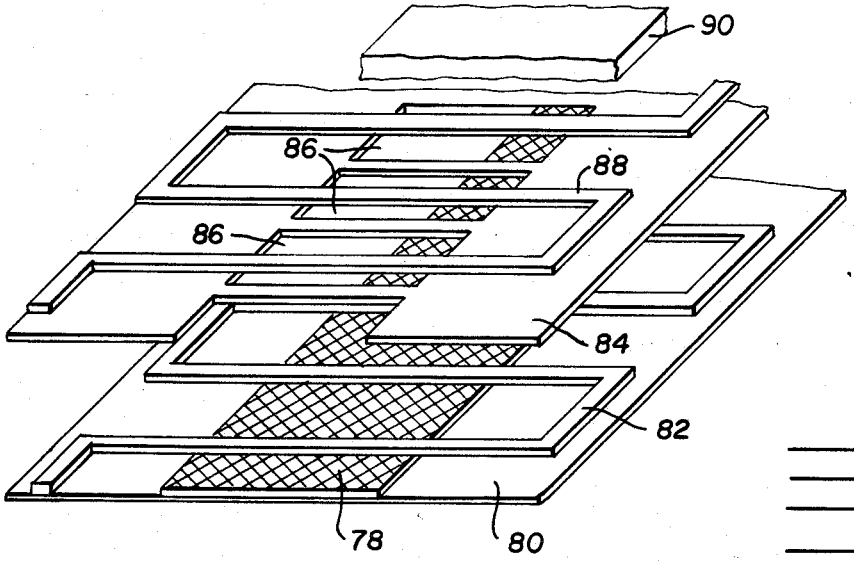
FIG. 7
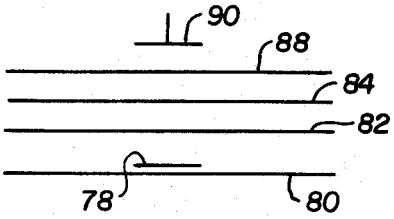
FIG. 8

BROADBAND TRANSVERSE FIELD INTERACTION CONTINUOUS BEAM AMPLIFIER

The invention described herein may be manufactured and used by or for the Government for governmental purposes without the payment of any royalties thereon or therefor.

CROSS REFERENCE TO RELATED APPLICATION

This application is related to co-pending application Ser. No. 640,184 entitled, "Transverse Field Interaction Multibeam Amplifier", filed in the name of Louis J. Jasper, Jr., et al. on July 2, 1984.

BACKGROUND OF THE INVENTION

Field of the Invention

This invention relates generally to high frequency amplification devices and more particularly to such a device where amplification results from interaction of electron beams with RF fields in wave propagation transmission lines.

Interaction types of devices for amplification of RF signals at microwave frequencies are well known. The traveling wave tube constitutes one such device wherein a longitudinal electron beam interacts continuously with the RF fields of a wave traveling along a slow wave propagating structure such as a helix. Additionally, means are provided to couple an external RF signal to and from the slow wave structure. The velocity of the electron beam, moreover, is adjusted to be approximately the same as the phase velocity of the wave propagating on the helix. When an RF wave is launched on the helix, the longitudinal component of the field interacts with the electrons traveling along in approximate synchronism with it. Some electrons will be accelerated while others will be decelerated, resulting in a progressive rearrangement in phase of the electrons with respect to the wave. The electron beam is thus modulated and induces RF fields on the helix. This process of mutual interaction continues along the length of the helix with the net result being that direct current energy is given up by the electrons to the traveling wave as radio frequency energy and the RF signal is thus amplified.

One example of a traveling wave tube is shown and described in U.S. Pat. No. 3.760,219, issued to Charles M. DeSantis, et al., one of the present inventors on Sept. 18, 1973. This patent discloses, among other things, a traveling wave tube having a control grid for producing klystron type of bunching of the electron stream. Another known type of microwave amplification device, which employs transverse field interaction for its operation, comprises a multibeam klystron which has been disclosed and described, for example, in a U.S. Army Ecom technical report entitled, "High Power Traveling Wave Multiple Beam Klystron", *Ecom-0007F Technical Reoort,* October, 1967, D.A. 28-043AMC-00007(e). There, two and three waveguide multiple beam klystron structures are shown and described that produce megawatts of power over a wide frequency band and at substantially lower beam voltages relative to single beam conventional klystrons. The multiple beam klystron utilizes a multiplicity of separate distinct electron beams that are arranged to transversely interact with RF fields in at least two more waveguides that are periodically loaded with capacitive gaps consisting of both buncher and catcher type gaps. The buncher gaps are driven by transverse RF waves traveling in one waveguide where the wave in turn modulates each of the beams. The beams then travel across the catcher gaps in the other waveguide where an amplified RF wave is induced therein and which is conveyed to an output circuit.

In the related application referenced above, a transverse field interaction multibeam amplifier device is disclosed comprised of a structure having a plurality of discrete cathode elements cylindrically located in succession along a central axis of RF propagation and wherein a respective number of annular collectors are located outwardly from the cathodes within a cylindrical housing structure. Intermediate the cathode and collector elements are two additional cylinders, one having a relatively smaller diameter than the other, but the smaller diameter cylinder including respective number of annular grids, while the larger cylinder comprises a structure having a corrugated or undulating slow wave wall surface structure and a respective number of apertures in the form of annular slots formed therein. The cathodes emit radial beams of electrons which pass through and are bunched by the adjoining grids and then accelerated by the slots to the collectors while interacting with and being modulated by an input beam propagating along the central axis of the cylindrical structure between a first pair of walls, for example, including the grids and cathodes and inducing an output beam in a second pair of walls, for example, including the grids and the cylinder including slow wave wall surface structure.

It is an object of the present invention, therefore, to provide an improvement in apparatus for amplifying electromagnetic waves.

It is a further object of the invention to provide an improvement in devices for amplifying microwave signals.

It is another object of the invention to provide improvement in microwave amplification devices which operate on the principle of field interaction between an electron beam and an RF signal propagating along a transmission line.

It is yet another object of the invention to provide improvement in field interaction amplification devices which are adapted to provide broadband operation.

SUMMARY

Briefly, the foregoing and other objects are achieved by means of a transverse field interaction continuous beam amplifier device comprised of an elongated continuous cathode modulating grid structure and an elongated continuous demodulating grid collector structure, first or input signal propagation transmission line means including a modulating grid of the cathode-grid structure for propagating an input RF wave transversely to an electron beam traveling from the cathode-grid structure to the demodulating grid-collector structure and operating to prebunch electron beams by transverse wave interaction, and second or output signal transmission propagation means including a demodulating grid of the demodulation grid-collector structure for propagating an induced amplified RF output wave resulting from prebunched electrons traversing the demodulating grid.

BRIEF DESCRIPTION OF THE DRAWINGS

FIG. 1 is a partial perspective view illustrative of one embodiment of the invention;

FIG. 2 is a partial perspective view illustrative of a modified version of the embodiment shown in FIG. 1;

FIG. 3 is a set of waveforms helpful in understanding the operation of the invention;

FIG. 4 is a partial perspective view of another embodiment of the invention;

FIG. 5 is a partial perspective view of an embodiment similar to the embodiment shown in FIG. 4;

FIGS. 6A–6D comprise a set of cross sectional views illustrative of those embodiments shown in FIGS. 4 and 5 as well as other modifications thereof;

FIG. 7 is a partial perspective view of yet another embodiment of the invention;

FIG. 8 is a simplified cross sectional view of the embodiment shown in FIG. 7;

DESCRIPTION OF THE PREFERRED EMBODIMENTS

Figure 9:
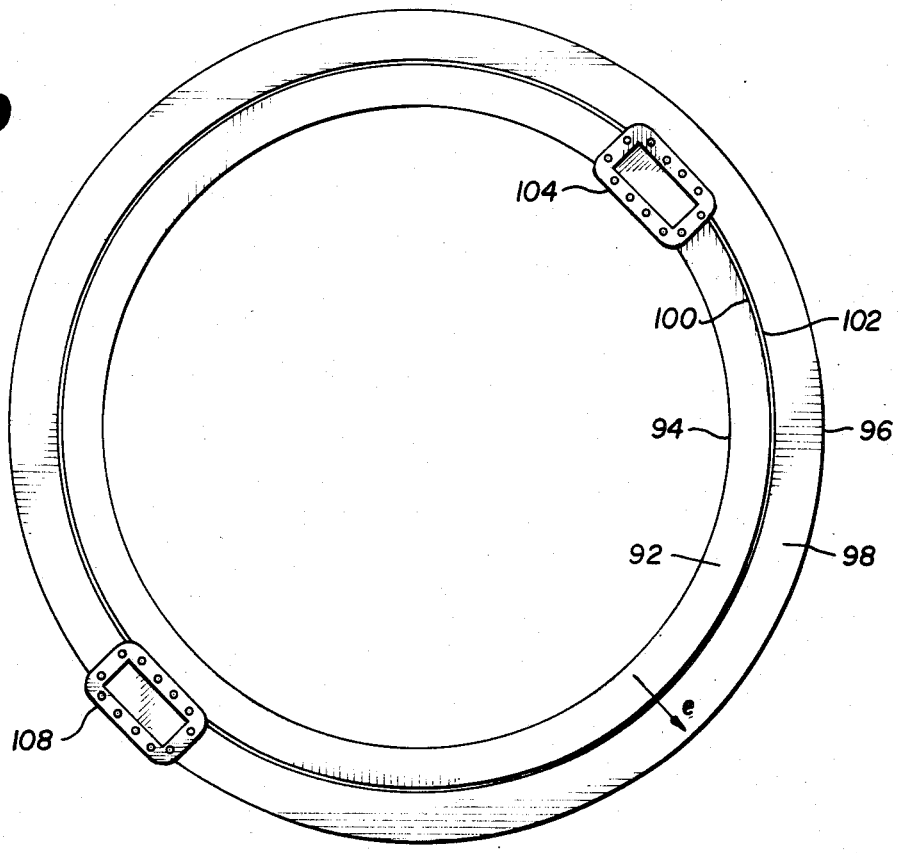
FIG. 9 is a top plan view of still another embodiment of the invention.

Referring now to the drawings and more particularly to FIG. 1, shown therein is a generally cylindrical structure of a first embodiment of the invention incorporating coaxial electrodes of a transverse field interaction device which includes a continuous cathode modulating grid RF input structure as well as a continuous demodulating grid-collector RF output structure. More particularly, the embodiment of FIG. 1 is comprised of and includes an innermost cylindrical continuous cathode electrode 10 which is adapted to envelop cathode heater means, not shown, which may consist of a plurality of discrete heater elements distributed along the length of the cathode cylinder 10 and connected in parallel or it may consist of a single elongated heater element. Although a thermionic cathode configuration is intended, it should also be noted that other types of electron emitter techniques may be employed such as cold cathodes or multipactor configurations having secondary emission surfaces. Also field emission from metal tips and high gradient electric fields may also be employed. In any event, what is intended to be shown is that the cathodic element is of a continuous nature along the entire length of the device. Outwardly adjacent the cathode cylinder 10 is a coaxial cylindrical member 12 which comprises a continuous control grid electrode (modulating grid) in the form of a rippled mesh.

A second rippled mesh 14 structure is situated outwardly of the modulating control grid 12 for operating as a demodulating grid. Next an outermost cylindrical member 16 operates not only as a protective housing for the device, but is additionally comprised of electron collector material for operating as a collector electrode. The continuous cathode and grid structures 10 and 12 form an RF input structure which guides and is additionally used to slow down RF waves coupled thereto. An RF output structure is formed by the demodulating grid structure 14 and collector structure 16. The rippled or undulating mesh configurations of the grids 12 and 14 provide a slow wave circuit for RF input and output waves. The slow wave circuit can take other forms when desired such as being ridged or comprised of undulating axial wires. Further as shown in FIG. 2, slow wave circuit means for modulating and demodulating grid structures 12' and 14' are comprised of spiral band or helix members 13 and 15, respectively integral therewith. The members 13 and 15 can also be configured in the form of helical wires.

In the embodiment shown in FIG. 1, the cathode cylinder 10 and the control grid cylinder 12 form an annular input waveguide type transmission line when an RF input signal is coupled thereto. This is shown schematically in FIG. 1 by an RF signal generator 20 coupled across the continuous electrode cylinders 10 and 12 by means of a coupling capacitor 22. Further as shown, the output wave propagation cylinder 14 and the inner surface 19 of the collector cylinder 16 form an annular output waveguide type transmission line from which an RF output signal can be taken across a load device $R_L$ shown as a load resistor 22 coupled across the cylinders 14 and 16 by means of a coupling capacitor 24.

As in most cathode-grid devices, a negative grid bias potential is applied to the control grid 12. This is provided in the embodiment of FIG. 1 by the grid bias potential $V_g$ whose positive terminal is returned to ground via the cathode cylinder 10 and whose negative terminal is connected to the grid control cylinder 12. The demodulating grid structure 14 has a positive bias potential $V_w$ applied thereto for providing an accelerating potential for electrons emanating from the cathode cylinder and passing through the control grid 12 and which are adapted to pass through the demodulating grid 14 and then to the inner collector surface 19 of the collector cylinder 16. The collector cylinder, moreover, is adapted to have the corresponding positive collector voltage $V_c$ applied thereto. The embodiment of FIG. 2 is likewise biased.

The operation of the embodiments shown in FIGS. 1 and 2 can be best understood in light of the set of waveforms illustrated in FIG. 3. Referring now to FIG. 3, reference numeral 26 denotes an RF input signal propagating along the cylindrical control grid such as grid 12 of FIG. 1 at three instances of time $t_1$, $t_2$ and $t_3$ with the input sine wave 26 moving from left to right as shown. As the electromagnetic wave 26 propagates and is guided by the grid structure 12, electrons 28 are emitted from the continuous cathode structure 10 during the positive half cycle of the input wave 26 which acts as a modulating sine wave causing bunching of the electrons 28 as shown by reference numeral 30. The bunched electrons result in radial beamlets of electrons which move to the right along with the progression of the RF input wave 26. However, individual electron motion within the beamlets 30 remain perpendicular or transverse to the wave motion and in so doing induce an RF output wave on the slow wave structure consisting of the cylinder 14 which forms the output waveguide including cylinder 16. The induced wave, moreover, builds up as it moves along with the modulating input wave. As can be appreciated, with a continuous cathode-grid structure, the separation of the electron beams is determined by the frequency of the RF input wave applied, whereas in the discrete cathode grid configuration disclosed in the above related application Ser. No. 640,184, only certain frequencies are optimum for maximum interaction due to the fact that the spacing between the beams is physically fixed. Thus broadband operation is inherently provided in the structure of this invention.

Referring now to FIG. 4, while the embodiment shown in FIG. 1 discloses a structure which is comprised of electrodes in the form of annular cylinders and providing thereby continuous electrodes for a transverse field interaction device, the embodiment of FIG. 4 is intended to illustrate a linear rectangular waveguide embodiment including a pair of contiguous ridge waveguide members 34 and 36 which respectively operate as input and output waveguides. Further as shown in FIG. 4, the input waveguide member 34 includes a centrally located inwardly projecting ridge section 38 which includes a flat planar continuous cathode element 40. The ridge section 38 is also adapted to envelop a cathode heater structure 42 for the continuous cathode 40. The ridged waveguide members 34 and 36, moreover, share a common broadwall 44 which contains an elongated relatively narrow continuous grid structure 46 comprised, for example, of a plurality of equally spaced wire members 48 which run transversely across and opposite from the cathode structure 40. The output waveguide member 36 also includes a centrally located ridge section 49 which is also adapted to include a grid structure 50 which is situated opposite the grid 46. The grid 46 comprises a modulating grid while the grid 50 acts as a demodulating grid. The demodulating grid structure 50 is likewise comprised of a plurality of equally spaced transverse wire members 51. Inside of the ridge section 49 there is located a continuous collector electrode structure 52 which runs the length of the waveguides 34 and 36 and having a generally concave collector surface 53 which faces the demodulating grid 50. Means, not shown for purposes of simplicity, for producing a slow wave in the structure can be provided in any desired known manner such as by dielectric loading, ridging or otherwise undulating the waveguide walls of the structure.

As in the cylindrical version of the invention, the embodiment shown in FIG. 4 operates in the same fashion, in that with an RF wave applied to the input waveguide 34, the modulating grid structure 46 produces a bunched electron beam which passes through grid 46 into the output waveguide 36, whereupon the bunched electron beam is demodulated by grid structure 50 inducing an RF wave in the output waveguide 36. The demodulated electron beam then passes through grid 50 to the continuous collector 52. The continuous interaction process of modulation and demodulation along the length of the input waveguide 34 and waveguide 36 results in amplification of the RF wave.

A modification of the rectangular ridge-waveguide embodiment of FIG. 4 is shown in FIG. 5 and comprises a waveguide configuration including an input waveguide member 34' and an output waveguide 36' which have separate adjacent broadwalls 45 and 47, respectively, instead of a common broadwall 44 as shown in FIG. 4. The input waveguide 34 includes a central ridged waveguide section 38 including the continuous cathode 40 as before but now the continuous modulating grid electrode 46 is included centrally along the broadwall 45 of the input waveguide 34'. Also now a second continuous demodulating grid structure 54 is located opposite the modulating grid 46 in a ridged waveguide section 56 formed centrally along the broadwall 47 of the output waveguide 36' and is situated beneath a demodulating grid structure 50 located in the ridged waveguide section 48 with the continuous collector electrode structure 52 projecting into the ridged waveguide section 48. Note that a physical separation providing electrical isolation between input 34' and output 36' waveguide permits an additional d.c. accelerating voltage, not shown, to be applied between waveguides 34' and 36'.

FIGS. 6A through 6D are intended to show that various types of rectangular waveguide configurations are possible. FIG. 6A, for example, discloses a simple cross section of the embodiment shown in FIG. 4 and describes what might be termed a mirror imaged guide configuration, whereas the cross section of FIG. 6B represents a cross section of the embodiment shown in FIG. 5. The cross section of FIG. 6C constitutes a repeated waveguide version consisting of a pair of like waveguides 34*a* and 34*b* stacked together in piggyback fashion such that they both include upwardly projecting ridged waveguide sections 38*a* and 38*b*, with ridged waveguide section 38*a* containing the continuous cathode structure 40 while ridged waveguide section 38*b* contains first a continuous demodulating grid structure 58 while the upper broadwall 60 contains a second demodulating grid structure 62. The upper broadwall 45 of the lower or input waveguide 34*a* contains the modulating grid structure 46. With respect to the configuration of FIG. 6D, it discloses a three waveguide configuration comprising a pair of waveguides 34, 36 such as shown in FIG. 6A with an intermediate waveguide member 66 having opposing ridged waveguide sections 68 and 70 which respectively include a first pair of demodulating grid structures 72 and 74 which are in registration with the modulating grid 46 in the broadwall 45 of the lower or input waveguide 34 and a second pair of demodulating grids 76 and 50 in the upper waveguide 36. In all instances, proper bias potentials are applied in a well known manner such as shown with respect to FIG. 1 in order to make the devices operable. Each waveguide structure, moreover, may be electrically isolated in a d.c. manner from the other(s) to provide application of additional acceleration potentials as suggested with respect to the embodiment of FIG. 5.

Referring now to FIG. 7, shown thereat is a planar configuration of a transverse field interacting device in accordance with the subject invention. As shown, a continuous cathode strip electrode 78 is formed on a metallic ground plane 80. Above the ground plane 80 and the cathode strip electrode 78 is located a continuous right angled meander line structure 82 which is adapted to operate as a modulating grid and a slow wave structure for an RF input signal which traverses the grid as a traveling wave in the conventional sense of a traveling wave device. This planar structure may be considered as an unwrapped version of the helical grid alternative of the device depicted in FIG. 2. The separation of these electrodes is further shown in the cross sectional view of FIG. 8. Next an apertured ground plane 84 including a set of regularly spaced rectangular slots 86 is adapted to be operable as a demodulating grid structure. Additionally, a second continuous right angled meander line structure 88 is positioned above the apertured ground plane 84 and is operable as an RF output circuit for an induced RF wave which propagates along the meander line as the input wave prebunches electrons emitting from the cathode strip 78 as movable beams of electrons to a continuous collector electrode 90.

Figure 10:
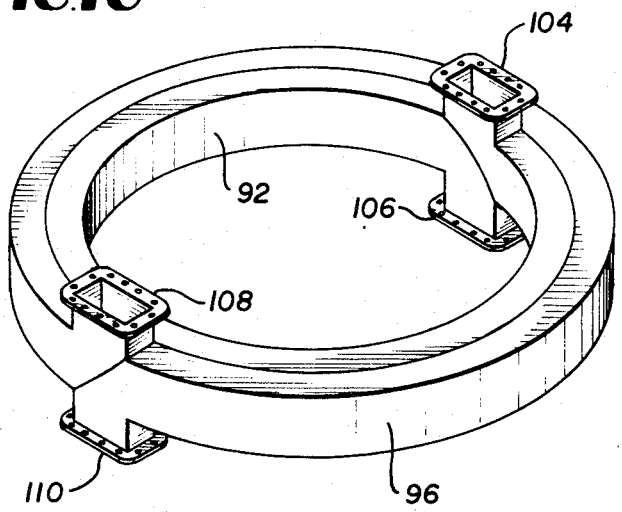
FIG. 10 is a perspective view illustrative of the embodiment shown in FIG. 9.

Up to this point what has been shown and described are several different versions of an elongated substantially linear transverse field interaction device employing electrodes which are continuous. Referring now to FIGS. 9 and 10, what is disclosed thereat is the concept of forming the rectangular waveguide members of FIGS. 4 and 5, for example, into a curvilinear or circular ring configuration. In FIG. 9, reference numeral 92 is intended to designate an input waveguide having a continuous cathode electrode structure, not shown, located on the inner surface of the wall 94 which is adapted to emit electrons radially outward to a continuous collector structure, not shown, located on the inner surface of the wall 96 in an outer contiguous output waveguide 98. The adjoining walls 100 and 102 of the input and output waveguides 92 and 98 respectively are adapted to include modulating and demodulating grids, not shown. The curvilinear input and output waveguides 92 and 98, moreover, each have offset waveguide flanges at each end. As shown in FIG. 10, the input waveguide includes a pair of connecting flanges 104 and 106 which project in mutually opposite directions at a common location on the ring configuration. The output waveguide 98 is likewise configured and includes a pair of flanges 108 and 110, which are shown displaced 180° around the ring from the flanges 104 and 106. When desirable, the position of the input and output waveguides can be reversed; however, as shown a relatively larger collector surface is provided which permits greater heat dissipation.

Thus what has been shown and described is a means for providing broadband operation of a transverse field interaction continuous beam amplifier device by the inclusion of continuous electrode elements, particularly the cathode and grid electrodes.

Having disclosed what are at present considered to be the preferred embodiments of the invention, it should be pointed out that they have been shown and described for purposes of illustration and not limitation. Accordingly, all alterations, modifications and changes coming within the spirit and scope of the invention as set forth in the appended claims are herein meant to be included.

1. A broadband microwave amplification device, comprising:

an elongated coaxial cylindrical cathode structure including a continuous cathode electrode which is operable to emit electrons substantially all along its length;

an elongated coaxial cylindrical electron collector structure including a continuous collector electrode extending in the same longitudinal direction as and located outwardly from said continuous cathode electrode;

slow wave means for modulating said electrons including an elongated coaxial cylindrical continuous modulating grid structure extending in said same longitudinal direction and transversely across the direct path of electrons between said continuous cathode and collector structures;

slow wave means for demodulating the modulated electrons including an elongated coaxial cylindrical continuous demodulating grid structure located between and co-extensive with said modulating grid and collector structures in the longitudinal and transverse directions across the direct path of electrons;

input RF signal propagation means including said cathode and said modulating grid structure for propagating an input RF wave longitudinally along the electron path for modulating and thereby prebunching said electrons into beamlets by the process of transverse wave interaction; and output RF signal propagation means including said collector and said demodulating grid structure for propagating therein an induced RF output wave in the same direction as said input RF wave and resulting from said prebunched electrons traversing said demodulating grid.

2. The device as defined by claim 1 wherein said slow wave means for modulating and demodulating electrons includes undulating meshes.

3. The device as defined by claim 1 wherein said slow wave means for modulating and demodulating electrons includes helical members.

4. The device as defined by claim 1, wherein said continuous cathode electrode comprises a first and innermost cylinder member, wherein said continuous collector electrode comprises a second and outermost cylinder member, wherein said continuous modulating grid structure comprises a third cylinder member adjacent said first cylinder member and having at least one surface forming said slow wave propagation means thereof and being part of said input RF signal propagation means, and wherein said continuous demodulating grid structure comprises a fourth cylinder member located intermediate said second and third cylinder members and having at least one surface forming part of said slow wave propagation means thereof and being said output RF signal propagation means.

* * * * *